US007811732B2

(12) United States Patent
Wu

(10) Patent No.: US 7,811,732 B2
(45) Date of Patent: Oct. 12, 2010

(54) TITANOCENE CONTAINING PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 12/059,587

(22) Filed: Mar. 31, 2008

(65) Prior Publication Data

US 2009/0246663 A1 Oct. 1, 2009

(51) Int. Cl.
*G03G 5/14* (2006.01)

(52) U.S. Cl. ..... 430/66; 430/58.8

(58) Field of Classification Search ..... 430/58.8, 430/66

See application file for complete search history.

(56) References Cited

U.S. PATENT DOCUMENTS

| | | | | |
|---|---|---|---|---|
| 4,265,990 | A | 5/1981 | Stolka et al. | |
| 4,298,697 | A | 11/1981 | Baczek et al. | |
| 4,338,390 | A | 7/1982 | Lu | |
| 4,464,450 | A | 8/1984 | Teuscher | |
| 4,555,463 | A | 11/1985 | Hor et al. | |
| 4,560,635 | A | 12/1985 | Hoffend et al. | |
| 4,587,189 | A | 5/1986 | Hor et al. | |
| 4,921,773 | A | 5/1990 | Melnyk et al. | |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 6,913,863 | B2 | 7/2005 | Wu et al. | |
| 7,378,203 | B2 * | 5/2008 | Jubran et al. | 430/58.35 |
| 2006/0210897 | A1 | 9/2006 | Jubran et al. | |
| 2007/0212626 | A1 | 9/2007 | Toshine et al. | |
| 2007/0292783 | A1 | 12/2007 | Wu et al. | |
| 2007/0292793 | A1 | 12/2007 | Wu et al. | |
| 2008/0014517 | A1 | 1/2008 | Wu et al. | |
| 2009/0246657 | A1 * | 10/2009 | Wu et al. | 430/58.5 |

FOREIGN PATENT DOCUMENTS

| | | |
|---|---|---|
| EP | 0 017 513 | 10/1980 |
| EP | 1 862 858 | 12/2007 |

OTHER PUBLICATIONS

Liang-Bih Lin et al., U.S. Appl. No. (Not Yet Assigned) on Thiuram Tetrasulfide Containing Photogenerating Layer, filed concurrently herewith, Mar. 31, 2008.

Liang-Bih Lin et al., U.S. Appl. No. (Not Yet Assigned) on Benzothiazole Containing Photogenerating Layer, filed concurrently herewith, Mar. 31, 2008.

Jin Wu et al., U.S. Appl. No. (Not Yet Assigned) on Thiuram Tetrasulfide Containing Photogenerating Layer, filed concurrently herewith, Mar. 31, 2008.

Jin Wu et al., U.S. Appl. No. (Not Yet Assigned) on Additive Containing Photoconductors, filed concurrently herewith, Mar. 31, 2008.

Jin Wu et al., U.S. Appl. No. (Not Yet Assigned) on Carbazole Hole Blocking Layer Photoconductors, filed concurrently herewith, Mar. 31, 2008.

Jin Wu, U.S. Appl. No. (Not Yet Assigned) on Oxadiazole Containing Photoconductors, filed concurrently herewith, Mar. 31, 2008.

Jin Wu et al., U.S. Appl. No. (Not Yet Assigned) on Thiadiazole Containing Photoconductors, filed concurrently herewith, Mar. 31, 2008.

Jin Wu et al., U.S. Appl. No. (Not Yet Assigned) on Overcoat Containing Titanocene Photoconductors, filed concurrently herewith, Mar. 31, 2008.

Daniel Levy et al., U.S. Appl. No. (Not Yet Assigned) on Urea Resin containing Photogenerating Layer Photoconductors, filed concurrently herewith.

Jin Wu et al., U.S. Appl. No. (Not Yet Assigned) on Metal Oxide Overcoated Photoconductors, filed concurrently herewith, Mar. 31, 2010.

Jin Wu et al., U.S. Appl. No. 11/605,523 on Polyhedral Oligomeric Silsesquioxane Thiophosphate Containing Photoconductors, filed Nov. 28, 2006, Mar. 31, 2008.

* cited by examiner

*Primary Examiner*—John L Goodrow
(74) *Attorney, Agent, or Firm*—Eugene O. Palazzo

(57) ABSTRACT

A photoconductor that includes, for example, a supporting substrate, a photogenerating layer, and a charge transport layer, and wherein at least one of the charge transport layer and the photogenerating layer contains a titanocene.

35 Claims, No Drawings

TITANOCENE CONTAINING PHOTOCONDUCTORS

CROSS REFERENCE TO RELATED APPLICATIONS

U.S. patent application Ser. No. 2009/0246658, filed concurrently herewith by Liang-Bih Lin et al. on Thiuram Tetrasulfide Containing Photogenerating Layer, the disclosure of which is totally incorporated herein by reference.

U.S. patent application Ser. No. 2009/0246659, filed concurrently herewith by Liang-Bih Lin et al. on Benzothiazole Containing Photogenerating Layer, the disclosure of which is totally incorporated herein by reference.

U.S. patent application Ser. No. 2009/0246662, filed concurrently herewith by Jin Wu et al. on Hydroxyquinoline Containing Photoconductors, the disclosure of which is totally incorporated herein by reference.

U.S. patent application Ser. No. 2009/0246660, filed concurrently herewith by Jin Wu on Additive Containing Photoconductors, the disclosure of which is totally incorporated herein by reference.

U.S. patent application Ser. No. 2009/0246668, filed concurrently herewith by Jin Wu on Carbazole Hole Blocking Layer Photoconductors, the disclosure of which is totally incorporated herein by reference.

U.S. patent application Ser. No. 2009/0246664, filed concurrently herewith by Jin Wu on Oxadiazole Containing Photoconductors, the disclosure of which is totally incorporated herein by reference.

U.S. patent application Ser. No. 2009/0246666, filed concurrently herewith by Jin Wu et al. on Thiadiazole Containing Photoconductors, the disclosure of which is totally incorporated herein by reference.

U.S. patent application Ser. No. 2009/0246657, filed concurrently herewith by Jin Wu et al. on Overcoat Containing Titanocene Photoconductors, the disclosure of which is totally incorporated herein by reference.

U.S. patent application Ser. No. 2009/0246661, filed concurrently herewith by Daniel Levy et al. on Urea Resin Containing Photogenerating Layer Photoconductors, the disclosure of which is totally incorporated herein by reference.

U.S. patent application Ser. No. 2009/0246665, filed concurrently herewith by Jin Wu et al. on Metal Oxide Overcoated Photoconductors, the disclosure of which is totally incorporated herein by reference.

In copending U.S. application Ser. No. 11/605,523, filed Nov. 28, 2006 on Polyhedral Oligomeric Silsesquioxane Thiophosphate Containing Photoconductors by Jin Wu et al., the disclosure of which is totally incorporated herein by reference, there is illustrated an imaging member comprising an optional supporting substrate; a photogenerating layer; and at least one charge transport layer wherein at least one of the charge transport layers is comprised of at least one charge transport component, at least one thiophosphate and at least one polyhedral oligomeric silsesquioxane (POSS)-containing material.

In copending U.S. application Ser. No. 11/453,743, U.S. Publication 20070292793, filed Jun. 15, 2006 on Thiophosphate Containing Photoconductors by Jin Wu et al., the disclosure of which is totally incorporated herein by reference, there is illustrated an imaging member comprising an optional supporting substrate, a photogenerating layer, and at least one charge transport layer, and wherein the photogenerating layer contains at least one thiophosphate.

U.S. application Ser. No. 11/485,645, U.S. Publication 20080014517, filed Jul. 12, 2006 on Silanol Containing Photoconductors by Jin Wu et al., the disclosure of which is totally incorporated herein by reference.

U.S. application Ser. No. 11/453,392, U.S. Publication 20070292783, filed Jun. 15, 2006 on Ether Phosphate Containing Photoconductors by Jin Wu et al., the disclosure of which is totally incorporated herein by reference.

A number of the components and amounts thereof of the above copending applications, such as the supporting substrates, resin binders, photogenerating layer components, antioxidants, charge transport components, hole blocking layer components, adhesive layers, and the like, may be selected for the photoconductors of the present disclosure in embodiments thereof.

BACKGROUND

This disclosure is generally directed to members, photoreceptors, photoconductors, and the like. More specifically, the present disclosure is directed to rigid, multilayered flexible, belt imaging members, or devices comprised of an optional supporting medium like a substrate, at least one of a photogenerating layer and a charge transport layer containing a titanocene, including a plurality of charge transport layers, such as a first charge transport layer and a second charge transport layer, an optional adhesive layer, an optional hole blocking or undercoat layer, and an optional overcoating layer. At least one in embodiments refers, for example, to one, to from 1 to about 10, to from 2 to about 7; to from 1 to about 4, and the like. Moreover, the titanocene can be added to the photogenerating layer or to at least one of the charge transport layers, and for example, instead of being dissolved in the charge transport layer solution, the titanocene can be added to the charge transport as a dopant, and more specifically, the titanocene can be added to the bottom charge transport layer.

Yet more specifically, there is disclosed a photoconductor comprised of a supporting substrate, a titanocene containing photogenerating layer, or a titanocene containing charge transport layer or charge transport layers, such as a first pass charge transport layer, a second pass charge transport layer, or both the first and second pass charge transport layers to primarily permit excellent photoconductor photosensitivites and an acceptable, and in embodiments a low $V_r$; and minimization or prevention of $V_r$ cycle up.

A number of advantages are associated with the photoconductors disclosed as indicated herein, and in embodiments, for example, increased photogenerating pigment sensitivity, minimal ghosting, and extended lifetimes. Additionally, in embodiments the photoconductors disclosed herein possess excellent, and in a number of instances low $V_r$ (residual potential), and allow the substantial prevention of $V_r$ cycle up when appropriate; high sensitivity; and low acceptable image ghosting characteristics.

Also disclosed are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, where a pigment precursor Type I chlorogallium phthalocyanine is prepared by the reaction of gallium chloride in a solvent, such as N-methylpyrrolidone, present in an amount of from about 10 parts to about 100 parts, with 1,3-diiminoisoindolene ($DI^3$) in an amount of from about 1 part to about 10 parts, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above recited patents may be selected for the present disclosure in embodiments thereof.

SUMMARY

Disclosed in embodiments are imaging members with many of the advantages illustrated herein, such as extended lifetimes of service of, for example, in excess of about 1,000,000 imaging cycles; excellent electrical characteristics; stable electrical properties; low image ghosting; low background and/or minimal charge deficient spots (CDS); consistent $V_r$ (residual potential) that is substantially flat or no change over a number of imaging cycles as illustrated by the generation of known PIDC (Photoinduced Discharge Curve), and the like. Also disclosed are layered photoresponsive imaging members which are responsive to near infrared radiation of from about 700 to about 900 nanometers.

Further disclosed are layered flexible photoconductive members with sensitivity to visible light.

Moreover, disclosed are rigid or drum and layered belt photoresponsive or photoconductive imaging members with mechanically robust charge transport layers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

EMBODIMENTS

Aspects of the present disclosure relate to an imaging member comprising an optional supporting substrate, a photogenerating layer, and at least one charge transport layer comprised of at least one charge transport component, and where the photogenerating layer or at least one charge transport layer contains a titanocene additive; a photoconductor comprising an optional supporting substrate, a photogenerating layer, and at least one charge transport layer wherein at least one of the charge transport layers is comprised of at least one charge transport component, and wherein at least one of the photogenerating layer and the charge transport layer includes a titanocene; a photoconductor comprising a supporting substrate, a photogenerating layer, and a charge transport layer, and wherein the charge transport layer and the photogenerating layer contains a titanocene, and wherein said titanocene is represented by

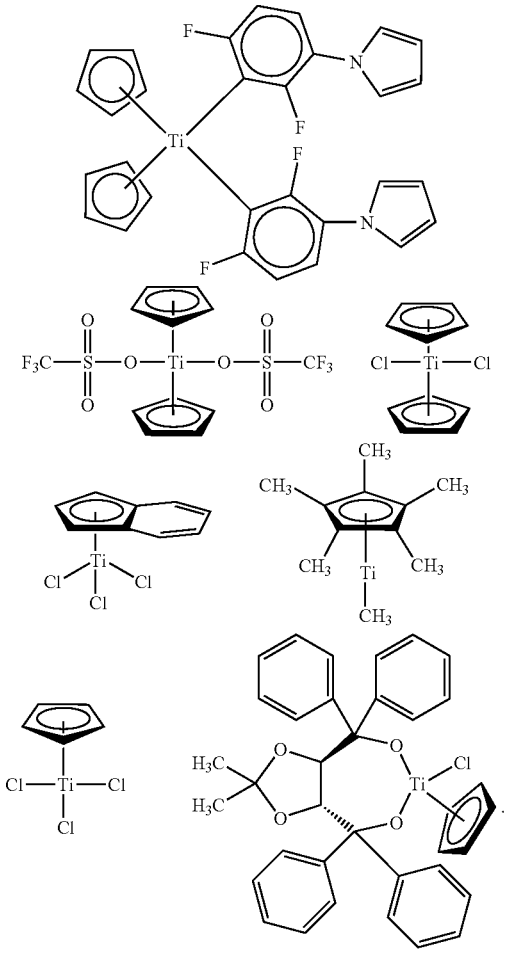

Various effective amounts of the titanocenes, which in embodiments function primarily as permitting excellent photoconductor electricals, like a high photosensitivity, for example at least 5 percent higher, as compared to similar photoconductors that are free of a titanocene, can be added to each charge transport layer and/or to the photogenerating layer components in an amount, for example, of from about 0.01 to about 30 weight percent, from about 0.1 to about 10 weight percent, or from about 0.2 to about 5 weight percent in the charge transport layer or layers; and from about 0.1 to about 40 weight percent, from about 1 to about 20 weight percent, or similar amounts in the photogenerating layer, such as from about 0.5 to about 30, 1 to about 20, 1 to about 7, 1 to about 5 weight percent, and wherein the photogenerating layer and at least one charge transport layer include a resin binder; wherein the at least one charge transport layer is from about 2 to about 7, and the photogenerating layer is situated between the substrate and the at least one charge transport layer; a drum, or flexible imaging member comprising a supporting substrate, a photogenerating layer, and at least two charge transport layers each of which contain a titanocene. In embodiments thereof, there is disclosed a photoconductive imaging member comprised of a supporting substrate, a photogenerating layer thereover, a charge transport layer, and an overcoat charge transport layer; a photoconductive member with a photogenerating layer of a thickness of from about 0.1 to about 10 microns, at least one transport layer each of a thickness of from about 5 to about 100 microns; a xerographic imaging apparatus containing a charging component, a development component, a transfer component, and a fixing component, and wherein the apparatus contains a photoconductive imaging member comprised of a supporting substrate, and thereover a layer comprised of a photogenerating pigment and a charge transport layer or layers, and thereover an overcoat charge transport layer, and where the transport layer is of a thickness of from about 10 to about 75 microns; a member wherein the titanocene or mixtures thereof is present in an amount of from about 0.1 to about 15 weight percent, or from about 0.3 to about 7 weight percent; a member wherein the photogenerating layer contains a photogenerating pigment present in an amount of from about 10 to about 95 weight percent; a member wherein the thickness of the photogenerating layer is from about 0.2 to about 4 microns; a member wherein the photogenerating layer contains an inactive polymer binder; a member wherein the binder is present in an amount of from about 20 to about 90 percent by weight, and wherein the total of all layer components is about 100 percent; a member wherein the photogenerating component is a hydroxygallium phthalocyanine or a titanyl phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate, or titanized polyethylene terephthalate; an imaging member wherein the photogenerating resinous binder is selected from the group consisting of known suitable polymers like polyesters, polyvinyl butyrals, polycarbonates, polystyrene-b-polyvinyl pyridine, and polyvinyl formals; an imaging member wherein the photogenerating pigment is a metal free phthalocyanine; a photoconductor wherein each of the charge transport layers, especially a first and second layer, comprises

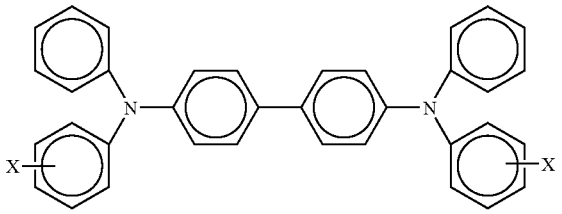

wherein X is selected from the group consisting of at least one of alkyl, alkoxy, and halogen such as methyl and chloride; and in embodiments where there is a total of four X substituents on each of the four terminating rings; an imaging member wherein alkyl and alkoxy contain from about 1 to about 15 carbon atoms; an imaging member wherein alkyl contains from about 1 to about 5 carbon atoms; an imaging member wherein alkyl is methyl; an imaging member wherein each of or at least one of the charge transport layers, especially a first and second charge transport layer, comprises

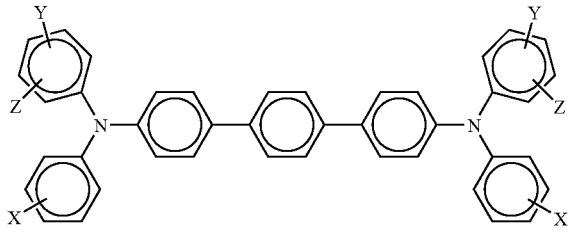

wherein X, Y and Z are independently selected from the group comprised of at least one of alkyl, alkoxy, aryl, and halogen, and in embodiments Z can be present, Y can be present, or both Y and Z are present; or wherein the charge transport component is

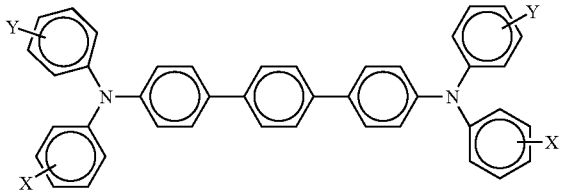

wherein X and Y are independently alkyl, alkoxy, aryl, a halogen, or mixtures thereof, an imaging member, and wherein, for example, alkyl and alkoxy contain from about 1 to about 15 carbon atoms; alkyl contains from about 1 to about 5 carbon atoms; and wherein the resinous binder is selected from the group consisting of polycarbonates, polyarylates and polystyrene; an imaging member wherein the photogenerating pigment present in the photogenerating layer is comprised of chlorogallium phthalocyanine, titanyl phthalocyanine, or Type V hydroxygallium phthalocyanine prepared by hydrolyzing a gallium phthalocyanine precursor by dissolving the hydroxygallium phthalocyanine in a strong acid, and then reprecipitating the resulting dissolved precursor in a basic aqueous media; removing the ionic species formed by washing with water; concentrating the resulting aqueous slurry comprised of water and hydroxygallium phthalocyanine to a wet cake; removing water from the wet cake by drying; and subjecting the resulting dry pigment to mixing with the addition of a second solvent to cause the formation of the hydroxygallium phthalocyanine; an imaging member wherein the Type V hydroxygallium phthalocyanine has major peaks, as measured with an X-ray diffractometer, at Bragg angles (2 theta+/−0.2°) 7.4, 9.8, 12.4, 16.2, 17.6, 18.4, 21.9, 23.9, 25.0, 28.1 degrees, and the highest peak at 7.4 degrees; a method of imaging wherein the imaging member is exposed to light of a wavelength of from about 400 to about 950 nanometers; a member wherein the photogenerating layer is situated between the substrate and the charge transport; a member wherein the charge transport layer is situated between the substrate and the photogenerating layer, and wherein the number of charge transport layers is 2; a member wherein the photogenerating layer is of a thickness of from about 0.5 to about 25 microns; a member wherein the photogenerating component amount is from about 0.05 weight percent to about 20 weight percent, and wherein the photogenerating pigment is dispersed in from about 10 weight percent to about 80 weight percent of a polymer binder; a member wherein the thickness of the photogenerating layer is from about 0.1 to about 11 microns; a member wherein the photogenerating and charge transport layer components are contained in a polymer binder; a member wherein the binder is present in an amount of from about 50 to about 90 percent by weight, and wherein the total of the layer components is about 100 percent; a photoconductor wherein the photogenerating resinous binder is selected from the group consisting of at least one of polyesters, polyvinyl butyrals, polycarbonates, polystyrene-b-polyvinyl pyridine, and polyvinyl formals; an imaging member wherein the photogenerating component is Type V hydroxygallium phthalocyanine, titanyl phthalocyanine, chlorogallium phthalocyanine, or mixtures thereof, and the charge transport layer contains a hole transport of N,N'-diphenyl-N,N-bis(3-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine molecules, and wherein the hole transport resinous binder is selected from the group consisting of polycarbonates and polystyrene; an imaging member wherein the photogenerating layer contains a metal free phthalocyanine; an imaging member wherein the photogenerating layer contains an alkoxygallium phthalocyanine; a photoconductive imaging member with a blocking layer contained as a coating on a substrate, and an adhesive layer coated on the blocking layer; an imaging member further containing an adhesive layer and a hole blocking layer; a color method of imaging which comprises generating an electrostatic latent image on the imaging member, developing the latent image, transferring, and fixing the developed electrostatic image to a suitable substrate; photoconductive imaging members comprised of a supporting substrate, a photogenerating layer, a hole transport layer, and a top overcoating layer in contact with the hole transport layer, or in embodiments in contact with the photogenerating layer, and in embodiments wherein a plurality of charge transport layers is selected, such as for example, from 2 to about 10, and more specifically, 2 may be selected; and a photoconductive imaging member comprised of an optional supporting substrate, a photogenerating layer, and a first, second, and third charge transport layer.

In embodiments, titanocenes are comprised of at least one cyclopentadienyl (Cp) or substituted cyclopentadienyl anion bound to a titanium center in the oxidation state IV.

Examples of titanocenes which are soluble or substantially soluble in a number of solvents include bis($\eta^5$-2,4-cyclopentadien-1-yl)bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, (4S,5S)-chloro-cyclopentadienyl-[2,2-dimethyl-1,3-dioxolan-4,5-bis(diphenylmethoxy)]titanium, and the like, and mixtures thereof.

Titanocenes that may be selected for the photogenerating layer, the charge transport layer, or charge transport layers can be represented by at least one of the following

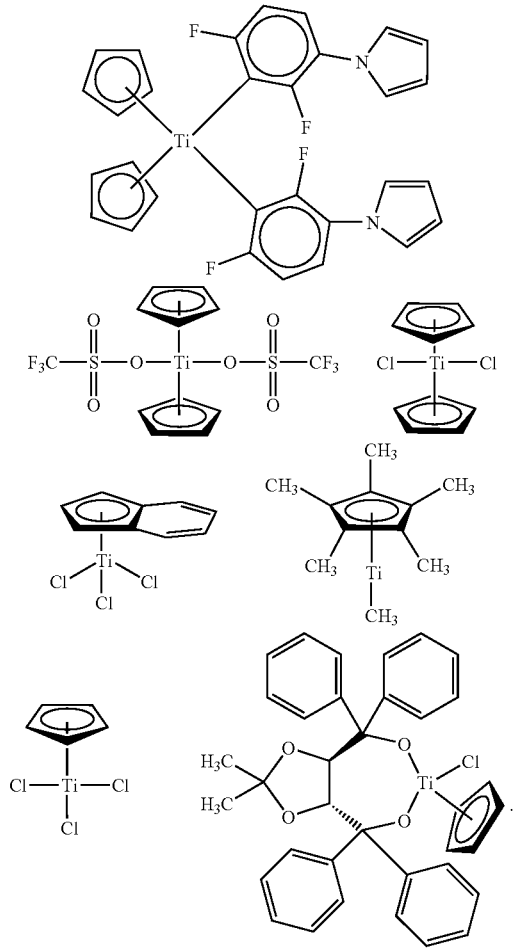

A number of suitable known substitutes or future developed substrates may be selected for the photoconductors disclosed. The thickness of the substrate layer depends on many factors, including economical considerations, electrical characteristics, and the like, thus this layer may be of substantial thickness, for example over 3,000 microns, such as from about 1,000 to about 3,500, from about 1,000 to about 2,000, from about 300 to about 700 microns, or of a minimum thickness of, for example, about 100 to about 500 microns. In embodiments, the thickness of this layer is from about 75 microns to about 300 microns, or from about 100 microns to about 150 microns.

The substrate may be opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of substantial thickness of, for example, up to many centimeters, or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

The photogenerating layer in embodiments is comprised of a number of known photogenerating pigments, and more specifically, hydroxygallium phthalocyanine, titanyl phthalocyanine, and chlorogallium phthalocyanine, and a resin binder like poly(vinyl chloride-co-vinyl acetate) copolymer, such as VMCH (available from Dow Chemical), or polycarbonate. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly (vinyl butyral), poly(vinyl carbazole), polyesters, polycarbonates, polyarylates, poly(vinyl chloride), polyacrylates and methacrylates, copolymers of vinyl chloride and vinyl acetate, phenolic resins, polyurethanes, poly(vinyl alcohol), polyacrylonitrile, polystyrene, other known suitable binders, and the like. It is desirable to select a coating solvent that does not substantially disturb or adversely affect the previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Group II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

The photogenerating composition or pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated photogenerating layer may be effected by any known conventional techniques such as oven drying, infrared radiation drying, air drying, and the like.

The coating of the photogenerating layer in embodiments of the present disclosure can be accomplished to achieve a final dry thickness of the photogenerating layer as illustrated herein, and for example, from about 0.01 to about 30 microns after being dried at, for example, about 40° C. to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the charge blocking, hole blocking layer, or interfacial layer, and the photogenerating layer. Usually, the photogenerating layer is applied onto the blocking layer, and a charge transport layer or plurality of charge transport layers are formed on the photogenerating layer. The photogenerating layer may be applied on top of or below the charge transport layer.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane, and polyacrylonitrile. This layer is, for example, of a thickness of from about 0.001 micron to about 1 micron, or from about 0.1 micron to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The optional hole blocking or undercoat layers for the imaging members of the present disclosure can contain a number of components including known hole blocking components, such as amino silanes, doped metal oxides, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol);

hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound containing, for example, at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene) bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

Charge transport layer components and molecules include a number of known materials as illustrated herein, such as aryl amines, which layer is generally of a thickness of from about 5 microns to about 75 microns, and more specifically, of a thickness of from about 10 microns to about 40 microns. Examples of charge transport layer components include

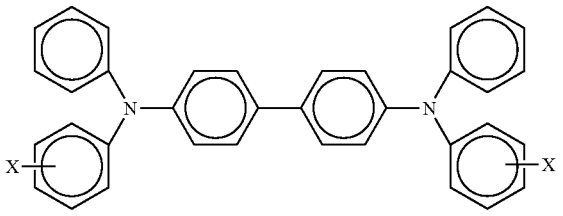

wherein X is alkyl, alkoxy, aryl, a halogen, or mixtures thereof, and especially those substituents selected from the group consisting of $C_1$ and $CH_3$; and molecules of the following formula

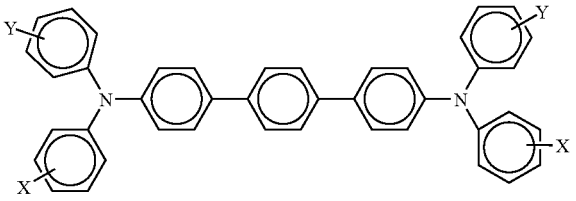

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis (halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine-diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the charge transport layer binders are comprised of polycarbonate resins with a weight average molecular weight of from about 20,000 to about 100,000, or with a molecular weight $M_w$ of from about 50,000 to about 100,000 preferred. Generally, in embodiments the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. If desired, the charge transport material in the charge transport layer may comprise a polymeric charge transport material, or a combination of a small molecule charge transport material and a polymeric charge transport material.

The thickness of each of the charge transport layers in embodiments is from about 5 to about 75 microns, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 micrometers. In embodiments, this thickness for each layer is from about 1 micrometer to about 5 micrometers. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration.

The overcoat can comprise the same components as the charge transport layer wherein the weight ratio between the charge transporting small molecules, and the suitable electrically inactive resin binder is, for example, from about 0/100 to about 60/40, or from about 20/80 to about 40/60.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. At least one refers, for example, to from 1 to about 5, from 1 to about 2, 1, 2, and the like. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. A Comparative Example and data are also provided.

Comparative Example 1

(A) An imaging member or photoconductor was prepared by providing a 0.02 micrometer thick titanium layer coated (coater device used) on a biaxially oriented polyethylene naphthalate substrate (KALEDEX™ 2000) having a thickness of 3.5 mils, and applying thereon, with a gravure applicator or an extrusion coater, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer using a gravure applicator or an extrusion coater, and which adhesive layer contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V), and 300 grams of ⅛ inch (3.2 millimeters) diameter stainless steel shot. The resulting mixture was then placed on a ball mill for 8 hours. Subsequently, 2.25 grams of PCZ-200 were dissolved in 46.1 grams of tetrahydrofuran, and added to the hydroxygallium phthalocyanine dispersion. The obtained slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micron.

The resulting imaging member web was then overcoated with two charge transport layers. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared by introducing into an amber glass bottle in a weight ratio of 0.35:0.65 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. The top layer solution was applied on the bottom layer of the charge transport layer to form a coating that upon drying (120° C. for 1 minute) had a thickness of 14.5 microns. During this coating process, the humidity was equal to or less than 15 percent.

(B) A photoconductor was prepared by repeating the above part (A), except that there was excluded the top charge transport layer and the thickness of the bottom charge transport layer was 29 microns.

Example I

A photoconductive member was prepared by repeating the process of Comparative Example 1 (A) except that there was included in the photogenerating layer 3 weight percent of bis($\eta^5$-2,4-cyclopentadien-1-yl)bis[2,6-difluoro-3-(1H-pyrrol-1-yl)phenyl]titanium (available as IRGACURE® 784, from Ciba Specialty Chemical (ratio of 45.6 pigment, 51.4 resin binder, bis($\eta^5$-2,4-cyclopentadien-1-yl)bis[2,6-difluoro-3-(1H-pyrrol-1-yl)phenyl]titanium) in THF (tetrahydrofuran), and 45.6151.413, about 6 weight percent solids.

Example II

A photoconductive member was prepared by repeating the process of Comparative Example 1 (A) except that there was included in the photogenerating layer 7 weight percent of bis($\eta^5$-2,4-cyclopentadien-1-yl)bis[2,6-difluoro-3-(1H-pyrrol-1-yl)phenyl]titanium (IRGACURE® 784, Ciba Specialty Chemical) in THF.

Example III

A photoconductive member was prepared by repeating the process of Comparative Example 1 (A) except that there was included in the bottom charge transport layer 0.2 weight percent of bis($\eta^5$-2,4-cyclopentadien-1-yl)bis[2,6-difluoro-3-(1H-pyrrol-1-yl)phenyl]titanium (IRGACURE® 784, Ciba Specialty Chemical in methylene chloride, about 15 percent solids.

Example IV

A photoconductive member is prepared by repeating the process of Comparative Example 1 (A) except that there is included in the top charge transport layer 0.2 weight percent of bis($\eta^5$-2,4-cyclopentadien-1-yl)bis[2,6-difluoro-3-(1H-pyrrol-1-yl)phenyl]titanium (IRGACURE® 784, Ciba Specialty Chemical), about 15 percent solids.

Example V

A number of photoconductors are prepared by repeating the process of Comparative Example 1 (A) except that there is included in the photogenerating layer, 3 weight percent, or the bottom charge transport layer, 0.2 weight percent, of at least one of titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

Example VI

A number of photoconductors are prepared by repeating the process of Comparative Example 1 (B) except that there is included in the photogenerating layer or the single bottom charge transport layer 3 and 0.2 weight percent, respectively, at least one of bis($\eta^5$-2,4-cyclopentadien-1-yl)bis[2,6-difluoro-3-(1H-pyrrol-1-yl)phenyl]titanium, titanocene bis(trifluoromethane sulfonate), titanocene dichloride, (indenyl)titanium (IV) trichloride, (pentamethylcyclopentadienyl) titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis (diphenylmethoxy)]titanium.

Electrical Property Testing

The above prepared photoreceptor devices (Comparative Example 1 (A) and Examples I and III) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities are measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 400 volts with the exposure light intensity incrementally increased by means of regulating a series of neutral density filters; the exposure light source was a 780 nanometer light emitting diode. The xerographic simulation was completed in an environmentally controlled light tight chamber at ambient conditions (40 percent relative humidity and 22° C.). The devices were also cycled to 10,000 cycles electrically with charge-discharge-erase. Six photoinduced discharge characteristic (PIDC) curves were generated, one for each of the above prepared photoconductors at both cycle=0 and cycle=10,000, and where V equals volt. The results are summarized in Table 1.

TABLE 1

| | V (3.5 ergs/cm$^2$) (V) | |
|---|---|---|
| | Cycle = 0 | Cycle = 10,000 |
| Comparative Example 1 (A) | 79 | 133 |
| Example I | 58 | 63 |
| Example III | 67 | 68 |

There is illustrated by the above Table 1 data a number of improved characteristics for the Example I and III photoconductive members as determined by the generation of known PIDC curves. More specifically, V (3.5 ergs/cm$^2$) in Table 1 represents the surface potential of the photoconductor device when exposure is 3.5 ergs/cm$^2$, and thus is used to characterize the PIDC. Incorporation of the titanocene into the photogenerating layer (Example I) reduced V (3.5 ergs/cm$^2$) by about 21V at cycle=0, while incorporation of the titanocene into the charge transport layer (Example III) reduced V (3.5 ergs/cm$^2$) by about 12V at cycle=0.

After 10,000 cycles, the V (3.5 ergs/cm$^2$) cycle up of Example I was about 5V, and the V (3.5 ergs/cm$^2$) cycle up of Example III was about 1V, which was only about one tenth of that of Comparative Example 1 (A) (54V). Therefore, incorporation of the titanocene into either the charge transport layer or the photogenerating layer resulted in improved (less) cycle up photoconductor characteristics.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and at least one charge transport layer wherein at least one of said charge transport layers is comprised of at least one charge transport component, and wherein at least one of said photogenerating layer and said charge transport layer includes a titanocene comprised of at least one cyclopentadienyl (Cp) or substituted cyclopentadienyl anion bound to a titanium center in the oxidation state IV.

2. A photoconductor in accordance with claim 1 wherein said titanocene is present in said photogenerating layer.

3. A photoconductor in accordance with claim 1 wherein said titanocene is present in at least one of said charge transport layers.

4. A photoconductor in accordance with claim 1 wherein said at least one charge transport layer is 1, 2 3, or 4 layers.

5. A photoconductor in accordance with claim 1 wherein said titanocene is present in said photogenerating layer, and in at least one of said charge transport layers.

6. A photoconductor in accordance with claim 1 wherein said titanocene is selected from the group consisting of at least one of bis($\eta^5$-2,4-cyclopentadien-1-yl)bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl) titanium (IV) trichloride, cyclopentadienyltitanium (IV)

trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

7. A photoconductor in accordance with claim 1 wherein said titanocene is bis($\eta^5$-2,4-cyclopentadien-1-yl)bis[2,6-difluoro-3-(1H-pyrrol-1-yl)phenyl]titanium.

8. A photoconductor in accordance with claim 2 wherein said titanocene is bis($\eta^5$-2,4-cyclopentadien-1-yl)bis[2,6-difluoro-3-(1H-pyrrol-1-yl)phenyl]titanium.

9. A photoconductor in accordance with claim 3 wherein said titanocene is bis($\eta^5$-2,4-cyclopentadien-1-yl)bis[2,6-difluoro-3-(1H-pyrrol-1-yl)phenyl]titanium.

10. A photoconductor in accordance with claim 1 wherein said titanocene is bis($\eta^5$-2,4-cyclopentadien-1-yl)bis[2,6-difluoro-3-(1H-pyrrol-1-yl)phenyl]titanium present in an amount of from about 0.01 to about 20 weight percent in the charge transport layer, and from about 0.1 to about 35 weight percent in the photogenerating layer.

11. A photoconductor in accordance with claim 2 wherein said titanocene is selected from the group consisting of at least one of bis($\eta^5$-2,4-cyclopentadien-1-yl)bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl) titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

12. A photoconductor in accordance with claim 3 wherein said titanocene is selected from the group consisting of at least one of bis($\eta^5$-2,4-cyclopentadien-1-yl)bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl) titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

13. A photoconductor in accordance with claim 1 wherein said titanocene is present in an amount of from about 0.01 weight percent to about 20 weight percent.

14. A photoconductor in accordance with claim 2 wherein said titanocene is present in an amount of from about 0.1 weight percent to about 20 weight percent.

15. A photoconductor in accordance with claim 3 wherein said titanocene is present in an amount of from about 0.02 weight percent to about 8 weight percent.

16. A photoconductor in accordance with claim 2 wherein said titanocene is present in an amount of from about 1 weight percent to about 5 weight percent.

17. A photoconductor in accordance with claim 3 wherein said titanocene is present in an amount of from about 0.1 weight percent to about 3 weight percent.

18. A photoconductor in accordance with claim 1 wherein said charge transport component is comprised of aryl amine molecules, and which aryl amines are of the formula

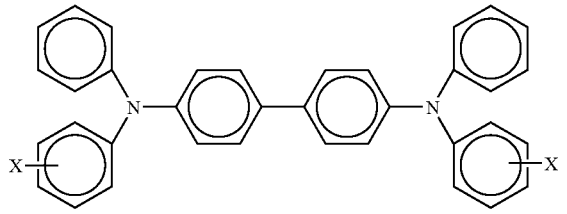

wherein X is selected from the group consisting of alkyl, alkoxy, aryl, and halogen, and mixtures thereof.

19. A photoconductor in accordance with claim 1 wherein said charge transport component is comprised of aryl amine molecules, and which aryl amines are of the formula

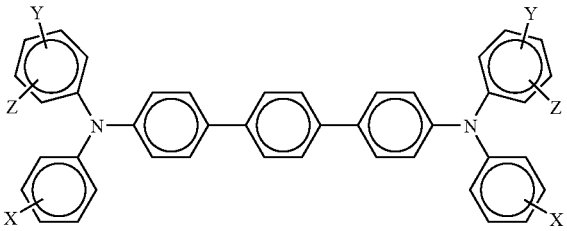

wherein X, Y, and Z are independently selected from the group consisting of alkyl, alkoxy, aryl, and halogen, and mixtures thereof.

20. A photoconductor in accordance with claim 1 wherein said charge transport component is selected from at least one of the group consisting of N,N'-bis(4-butylphenyl)-N,N'-di-p-tolyl-[p-terphenyl]-4,4"-diamine, N,N'-diphenyl-N,N-bis(3-methylphenyl)-1,1'-biphenyl-4,4'-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine; and wherein said titanocene is selected from the group consisting of at least one of bis($\eta^5$-2,4-cyclopentadien-1-yl)bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

21. A photoconductor in accordance with claim 1 further including in at least one of said charge transport layers an antioxidant comprised of a hindered phenolic, a hindered amine, and mixtures thereof, and wherein said titanocene is selected from the group consisting of at least one of bis($\eta^5$-2,4-cyclopentadien-1-yl)bis[2,6-difluoro-3-(1H-pyrrol-1-yl)phenyl]titanium, titanocene bis(trifluoromethane sulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

22. A photoconductor in accordance with claim 1 wherein said photogenerating layer is comprised of a photogenerating pigment or photogenerating pigments.

23. A photoconductor in accordance with claim 21 wherein said photogenerating pigment is comprised of at least one of a titanyl phthalocyanine, a hydroxygallium phthalocyanine, a halogallium phthalocyanine, a perylene, or mixtures thereof.

24. A photoconductor in accordance with claim 22 wherein said photogenerating pigment is comprised of a metal phthalocyanine, a metal free phthalocyanine, a perylene, or mixtures thereof, and wherein said titanocene is selected from the group consisting of at least one of bis($\eta^5$-2,4-cyclopentadien-1-yl)bis[2,6-difluoro-3-(1H-pyrrol-1-yl)phenyl]titanium, titanocene bis(trifluoromethane sulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

25. A photoconductor in accordance with claim 24 wherein said photogenerating pigment is comprised of a hydroxygallium phthalocyanine, or a titanyl phthalocyanine.

26. A photoconductor in accordance with claim 1 further including a hole blocking layer, and an adhesive layer.

27. A photoconductor in accordance with claim 1 wherein said at least one charge transport layer is from 1 to about 4 layers.

28. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer, and wherein said titanocene is selected from the group consisting of at least one of bis($\eta^5$-2,4-cyclopentadien-1-yl) bis[2,6-difluoro-3-(1H-pyrrol-1-yl)phenyl]titanium, titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

29. A photoconductor comprising a supporting substrate, a photogenerating layer, and a charge transport layer, and wherein said charge transport layer and said photogenerating layer contains a titanocene comprised of at least one cyclopentadienyl (Cp) or substituted cyclopentadienyl anion bound to a titanium center in the oxidation state IV.

30. A photoconductor in accordance with claim 29 wherein said photogenerating layer contains said titanocene, and a photogenerating component.

31. A photoconductor in accordance with claim 29 wherein said charge transport layer contains said titanocene, hole transport molecules, and a polymer.

32. A photoconductor in accordance with claim 29 wherein said titanocene is represented by at least one of bis($\eta^5$-2,4-cyclopentadien-1-yl)bis[2,6-difluoro-3-(1H-pyrrol-1-yl) phenyl]titanium, titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

33. A photoconductor in accordance with claim 31 wherein said titanocene is represented by at least one of bis($\eta^5$-2,4-cyclopentadien-1-yl)bis[2,6-difluoro-3-(1H-pyrrol-1-yl) phenyl]titanium, titanocene bis(trifluoromethanesulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)]titanium.

34. A photoconductor in accordance with claim 1 wherein said titanocene is represented by

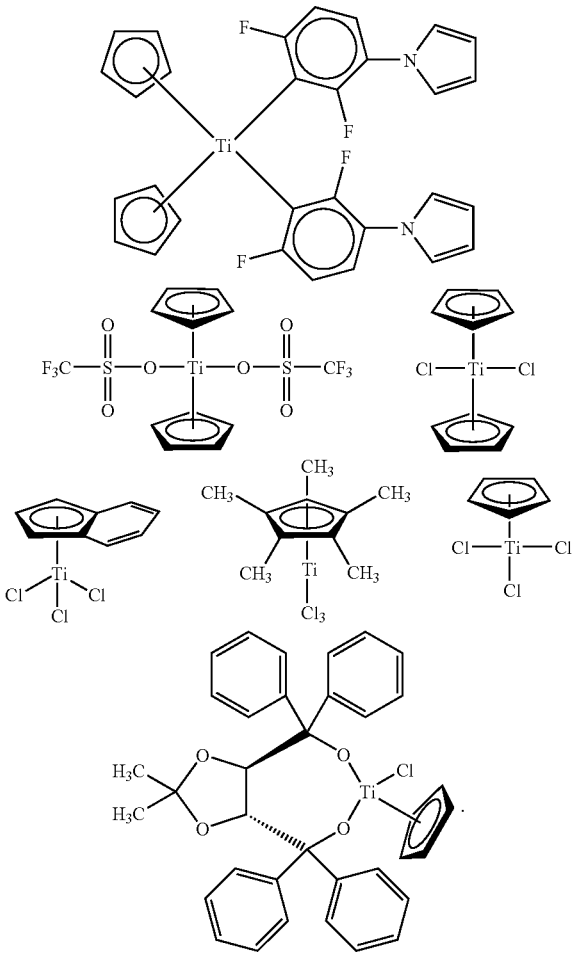

35. A photoconductor comprised of a supporting substrate, a photogenerating layer, and at least one charge transport layer, and wherein said photogenerating layer, or said at least one charge transport layer, or said photogenerating layer, and said charge transport layer contains a titanocene selected from the group consisting of at least one of bis($\eta^5$-2,4-cyclopentadien-1-yl)bis[2,6-difluoro-3-(1H-pyrrol-1-yl)phenyl]

titanium, titanocene bis(trifluoromethane sulfonate), titanocene dichloride, (indenyl)titanium (IV) trichloride, (pentamethylcyclopentadienyl)titanium (IV) trichloride, cyclopentadienyltitanium (IV) trichloride, bis(cyclopentadienyl)titanium (IV) pentasulfide, (4R,5R)-chloro-cyclopentadienyl-[2,2-dimethyl-1,3-dioxolan-4,5-bis(diphenylmethoxy)]titanium, and (4S,5S)-chloro-cyclopentadienyl-[2,2-dimethyl-1,3-dioxolan-4,5-bis(diphenylmethoxy)] titanium, and wherein said titanocene amount is from about 0.1 to about 10 weight percent.

* * * * *